US009422886B2

(12) United States Patent
Farooqui et al.

(10) Patent No.: US 9,422,886 B2
(45) Date of Patent: Aug. 23, 2016

(54) CYLINDER HEAD ASSEMBLY HAVING COOLED VALVE INSERT

(71) Applicant: Electro-Motive Diesel Inc., LaGrange, IL (US)

(72) Inventors: Seema Iffat Farooqui, Westmont, IL (US); Raji Rexavier, Plainfield, IL (US)

(73) Assignee: Electro-Motive Diesel, Inc., La Grange, IL (US)

( * ) Notice: Subject to any disclaimer, the term of this patent is extended or adjusted under 35 U.S.C. 154(b) by 0 days.

(21) Appl. No.: 13/935,272

(22) Filed: Jul. 3, 2013

(65) Prior Publication Data

US 2015/0007792 A1 Jan. 8, 2015

(51) Int. Cl.

| | |
|---|---|
| ***F02F 1/40*** | (2006.01) |
| ***F01L 3/02*** | (2006.01) |
| ***F01L 3/22*** | (2006.01) |
| *F02F 1/24* | (2006.01) |

(52) U.S. Cl.

CPC ... *F02F 1/40* (2013.01); *F01L 3/02* (2013.01); *F01L 3/22* (2013.01); *F01L 2103/00* (2013.01); *F01L 2810/01* (2013.01); *F02F 2001/248* (2013.01)

(58) Field of Classification Search

CPC ..... F02F 1/40; F02F 1/4214; F02F 1/14; F01L 3/16; F01L 3/22; F01L 3/06

USPC ..... 123/41.82 R, 41.85, 188.8, 188.9, 193.5

See application file for complete search history.

(56) References Cited

U.S. PATENT DOCUMENTS

| | | | | |
|---|---|---|---|---|
| 3,176,666 | A * | 4/1965 | Whitehead | 123/41.82 R |
| 3,285,235 | A | 11/1966 | Ueberschaer | |
| 3,822,680 | A * | 7/1974 | Showalter et al. | 123/41.85 |
| 4,147,149 | A | 4/1979 | Andrea | |
| 4,522,161 | A | 6/1985 | Slee | |
| 5,379,729 | A | 1/1995 | Yonezwa et al. | |
| 5,745,993 | A | 5/1998 | Adachi et al. | |
| 5,970,614 | A | 10/1999 | Adachi et al. | |
| 6,024,057 | A | 2/2000 | Betchaku | |
| 6,260,531 | B1 | 7/2001 | Haan et al. | |
| 6,536,397 | B2 | 3/2003 | Mizutani | |
| 6,997,144 | B2 | 2/2006 | Sugano et al. | |
| 7,063,051 | B2 * | 6/2006 | Schellhase | 123/41.85 |
| 7,069,885 | B2 | 7/2006 | Iida | |
| 7,216,427 | B2 | 5/2007 | Trudeau et al. | |
| 8,127,735 | B2 | 3/2012 | Becker et al. | |
| 8,596,239 | B2 * | 12/2013 | Escriva et al. | 123/41.82 R |
| 2002/0124815 | A1 | 9/2002 | Ishiguro et al. | |
| 2004/0182332 | A1 | 9/2004 | Schellhase | |
| 2005/0051114 | A1 | 3/2005 | Baba et al. | |

(Continued)

FOREIGN PATENT DOCUMENTS

| | | | |
|---|---|---|---|
| DE | 3205676 | A1 * | 9/1982 |
| DE | 4328904 | A1 * | 4/1994 |

(Continued)

*Primary Examiner* — Hung Q Nguyen
*Assistant Examiner* — Kevin Lathers
(74) *Attorney, Agent, or Firm* — Finnegan, Henderson, Farabow, Garrett & Dunner, LLP

(57) ABSTRACT

An cylinder head assembly is disclosed. The cylinder head assembly may include a cylinder head having a stepped bore associated with a valve opening. The cylinder head assembly may also include an insert configured to engage the stepped bore, and a cooling passage at least partially formed by the insert and the stepped bore.

18 Claims, 4 Drawing Sheets

(56) References Cited

U.S. PATENT DOCUMENTS

| | | | |
|---|---|---|---|
| 2008/0072948 | A1 | 3/2008 | McGilvray et al. |
| 2011/0220043 | A1 | 9/2011 | Escriva et al. |

FOREIGN PATENT DOCUMENTS

| | | | | |
|---|---|---|---|---|
| EP | 186888 | A1 | * | 7/1986 |
| EP | 2329115 | A1 | * | 6/2011 |
| GB | 668962 | | * | 3/1952 |
| GB | 2009846 | A | * | 6/1979 |
| GB | 2021691 | A | * | 12/1979 |
| JP | 62045916 | A | * | 2/1987 |
| JP | 05033640 | A | * | 2/1993 |
| JP | 06042320 | A | * | 2/1994 |
| WO | 2008059108 | | | 5/2008 |

* cited by examiner

CYLINDER HEAD ASSEMBLY HAVING COOLED VALVE INSERT

TECHNICAL FIELD

The present disclosure relates generally to a cylinder head assembly, and more particularly, to a cylinder head assembly having a cooled valve insert.

BACKGROUND

An internal combustion engine generally includes one or more combustion chambers that house a combustion process to produce mechanical work and a flow of exhaust. Each combustion chamber is defined by a cylinder, a top surface of a piston, and a bottom surface of a cylinder head. Air or an air/fuel mixture is directed into the combustion chamber by way of intake ports in the cylinder head, and a resulting exhaust flow is discharged from the combustion chamber by way of exhaust ports also in the cylinder head. Valves are located within bores associated with the intake and exhaust ports and sealed against valve seat inserts to selectively allow and block the flows of air and exhaust through the intake and exhaust ports.

Traditional valve seat inserts are pressed into their respective bores and then, machined to specific tolerances, allowing the valves to seat properly. While successful, this machining process may not be cost effective. In particular, machining the valve seat inserts after installation into their respective bores can require additional tooling and be difficult to perform in the field.

During engine operation, cylinder heads, valves, and valve seat inserts are exposed to high stresses and temperatures. And, over time, these high stresses and temperatures can cause excessive wear of the cylinder head, the valves, and the valve seat inserts.

One solution to the high stresses and temperatures described above is disclosed in U.S. Pat. No. 5,745,993 ("the '993 patent") issued to Adachi et al. on May 5, 1998. The '993 patent describes a reciprocating machine having a cylinder head including intake and exhaust flow passages that are controlled by intake and exhaust poppet-type valves. Each valve has a head portion that cooperates with a respective valve seat formed at lower ends of the intake and exhaust flow passages. The cylinder head utilizes a valve insert ring to form the valve seat that is press-fit within each flow passage. One or more water jackets are formed within the cylinder head and provide cooling for the cylinder head, the valves, and/or the valve insert rings.

Although the water jackets of the '993 patent help to provide some cooling for the valves and the valve insert rings, it may still be less than optimal. Specifically, the water jackets of the '993 patent are located a distance from the valve insert rings, and this distance may limit the amount of heat that can transfer from the valve insert rings and their respective valves to coolant in the water jacket. Additionally, the valve insert rings of the '993 patent are first inserted into their respective positions and then, machined into place. This machining process may be expensive and limit remanufacturing options.

The cylinder head assembly of the present disclosure solves one or more of the problems set forth above and/or other problems with existing technologies.

SUMMARY OF THE DISCLOSURE in one aspect, the present disclosure is directed to a cylinder head assembly. The cylinder head assembly may include a cylinder head having a stepped bore associated with a valve opening. The cylinder head assembly may also include an insert configured to engage the stepped bore, and a cooling passage at least partially formed by the insert and the stepped bore.

In another aspect, the present disclosure is directed to a method of cooling a cylinder head assembly. The method may include directing coolant into a cylinder head, and circulating coolant from the cylinder head through a cooling passage at least partially surrounding and formed by a valve insert.

DETAILED DESCRIPTION

Figure 1:
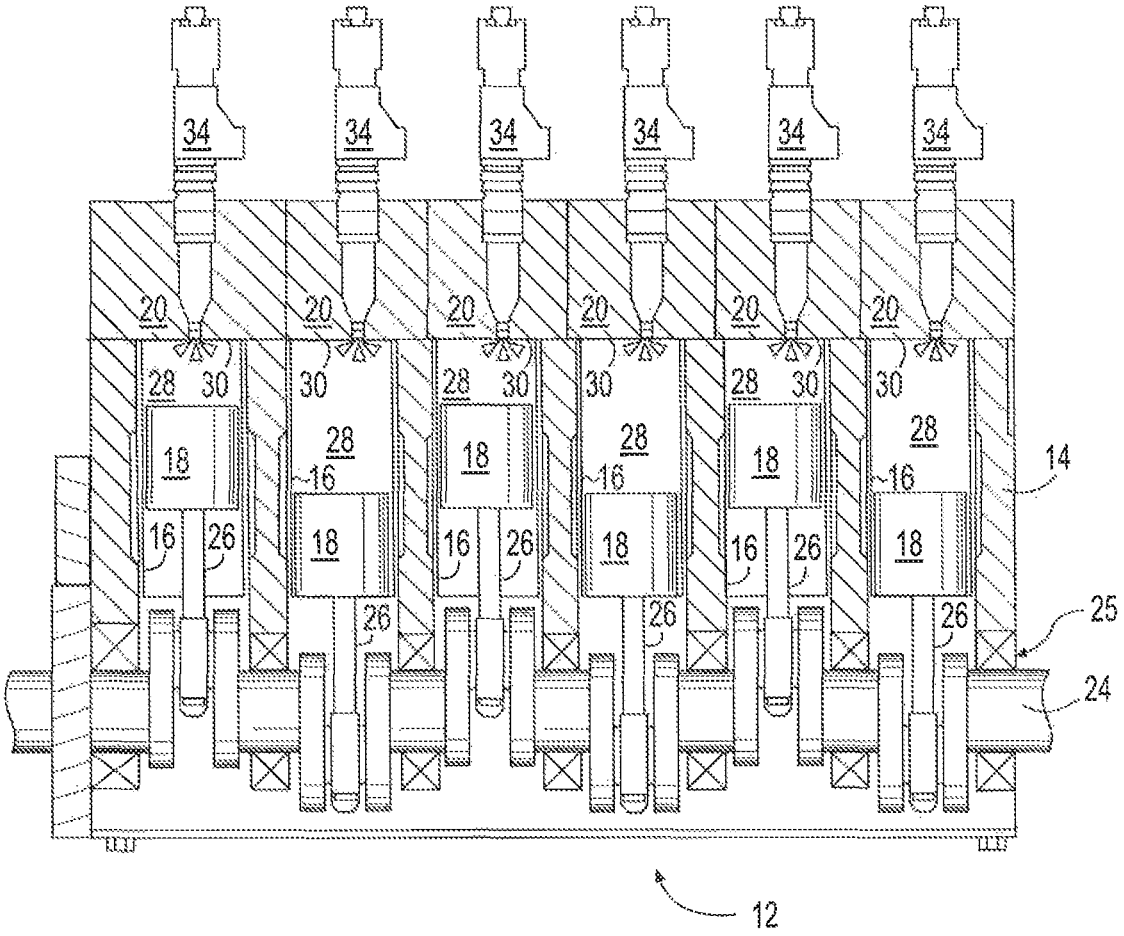
FIG. 1 is a pictorial illustration of an exemplary disclosed engine.

FIG. 1 illustrates an exemplary engine 12. For the purposes of this disclosure, engine 12 is depicted and described as a four-stroke diesel engine. One skilled in the art will recognize, however, that engine 12 may be any other type of combustion engine such as, for example, a two- or four-stroke gasoline or gaseous fuel-powered engine.

Engine 12 may include an engine block 14 that at least partially defines a plurality of cylinders 16. A piston 18 may be slidably disposed within each cylinder 16 to reciprocate between a top-dead-center position and a bottom-dead-center position, and a cylinder head 20 may be associated with each cylinder 16. Each cylinder 16, piston 18, and cylinder head 20 may together at least partially define a combustion chamber 28. A fuel injector 34 may be at least partially disposed within each cylinder head 20 and configured to inject fuel into each respective combustion chamber 28 to support fuel combustion within engine 12. Engine 12 may also include a crankshaft 24 that is rotatably supported within engine block 14 by way of a plurality of journal bearings 25. A connecting rod 26 may connect each piston 18 to crankshaft 24 so that a sliding motion of piston 18 within each respective cylinder 16 results in a rotation of crankshaft 24.

Figure 2:
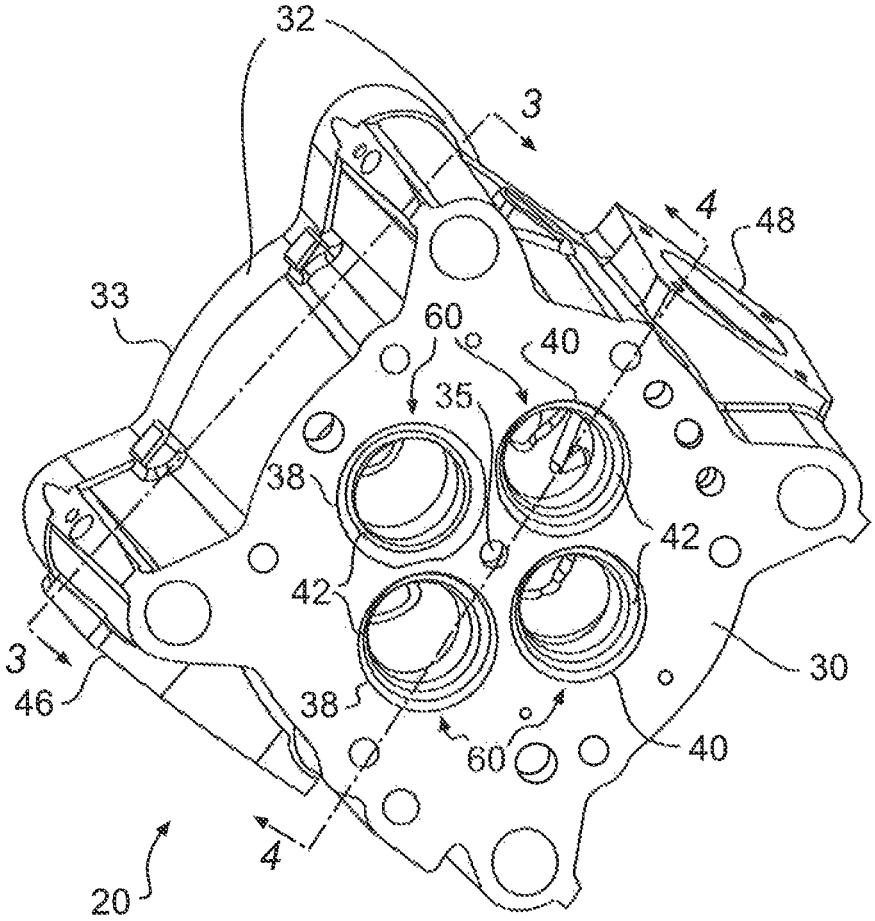
FIG. 2 is a pictorial illustration of an exemplary disclosed cylinder head assembly that may be utilized in conjunction with the engine of FIG. 1.

As shown in FIG. 2, cylinder head 20 may include a bottom deck, or firedeck surface 30, a plurality of side surfaces 32, and a top surface 33. Firedeck surface 30 of cylinder head 20 may include a fuel injector opening 35 associated with fuel injector 34 and two or more valve openings. In the embodiment shown, the valve openings include a pair of intake valve openings 38 and a pair of exhaust valve openings 40. It is contemplated, however, that, in some embodiments, firedeck surface 30 may have only one intake valve opening 38 and/or one exhaust valve opening 40. Valve openings 38, 40 may be evenly spaced about fuel injector opening 35. A passage (not shown) may be defined within cylinder head 20 extending from each valve opening 38, 40 to a respective one of an intake port 46 and an exhaust port 48. Intake and exhaust ports 46, 48 may be disposed in side surfaces 32 of cylinder head 20 to allow air and exhaust to enter and exit cylinder head 20.

Also shown in FIG. 2, cylinder head 20 may have a stepped bore 60 associated with each valve opening 38, 40. A generally circular or ring-shaped valve seat insert 42 may be configured to engage each stepped bore 60 and provide a seating surface for a respective one of an intake valve or an exhaust valve (not shown). During engine operation, valve seat inserts 42 may serve to protect cylinder head 20 from excessive wear and/or corrosion resulting from contact with the intake and exhaust valves. Valve seat inserts 42 may also provide a tight seal with the intake and exhaust valves to selectively block unintended leakage of air and exhaust into or out of combustion chamber 28 (referring to FIG. 1).

In the disclosed embodiment, valve seat inserts 42 are preferably manufactured from a durable, wear-resistant, and heat-resistant material, such as a high nickel steel. Cylinder head 20, on the other hand, may be made of cheaper materials, such as a ductile iron. Valve seat inserts 42 may be pre-machined prior to installation into their respective stepped bores 60. This pre-machining process may include machining precise diameters, curvatures, angles, and/or any other geometrical aspects of both inner and outer surfaces of valve seat insert 42. By completely pre-machining valve seat inserts 42 prior to installation, this may allow manufacturers to cut down on labor time and cost. Also, having pre-machined valve seat inserts 42 may facilitate field replacement of valve seat inserts 42 and/or maintenance of cylinder head 20. It is contemplated that stepped bores 60 may also be pre-machined to precise diameters, curvatures, angles, and/or any other geometrical aspects prior to installment of each respective valve seat insert 42. By having both pre-machined stepped bores 60 and pre-machined valve seat inserts 42, this may allow for proper alignment of stepped bores 60 and valve seat inserts 42 without a need for additional machining.

Figure 3:
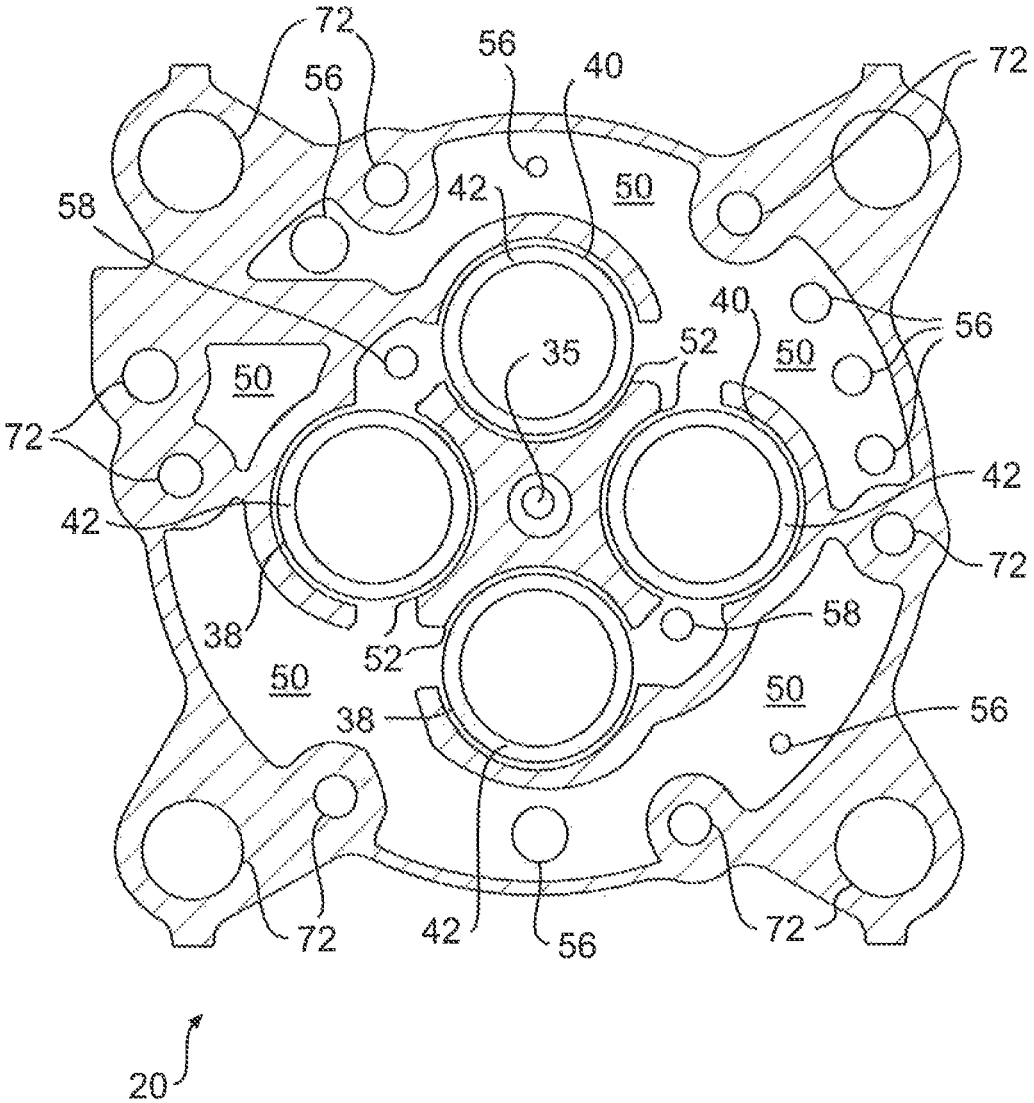
FIG. 3 is a cross-sectional view illustration taken along line 3-3 of the cylinder head assembly of FIG. 2.

FIG. 3 illustrates a cross sectional view illustration taken along line 3-3 of cylinder head 20 shown in FIG. 2. Internally, cylinder head 20 may include a plurality of cooling passages 50 configured to facilitate the transfer of thermal energy away from cylinder head 20, intake and exhaust valves, and/or valve seat inserts 42. Cooling passages 50 may include, for example, water jackets that utilize a coolant, such as glycol, water, a water/glycol mixture, or another coolant known in the art. The coolant may enter cooling passages 50 through one or more inlet passages 56, and exit cooling passages 50 through one or more outlet passages 58. In the embodiment shown, there are a plurality of inlet passages 56 and a plurality of outlet passages 58. Inlet passages 56 and outlet passages 58 may be in fluid communication with cooling passages 50 and one or more additional cooling components of engine 12. Also shown in FIG. 3, one or more mounting holes 72 may be disposed within cylinder head 20 and be configured to attach cylinder head 20 to engine block 14 (referring to FIG. 1) using a plurality of bolts, or by any other form of attachment known in the art.

In the disclosed embodiment, cooling passages 50 extend from outer edges of cylinder head 20 towards a center of cylinder head 20. Cooling passages 50 may function as distribution passages, and connect to multiple smaller cooling passages 52 that substantially surround one or more valve seat inserts 42. As shown in FIG. 3, each cooling passage 52 may entirely surround a periphery of each respective valve seat insert 42 associated with one of intake or exhaust valve opening 38, 40. In addition, cooling passages 52 may be in fluid communication with each other. For example, in the embodiment shown, each cooling passage 52 is connected to two adjacent cooling passages 52 associated with adjacent valve openings 38, 40. It is contemplated that, in other embodiments, cooling passages 52 may be fluidly connected at the center of cylinder head 20, such that all cooling passages 52 may be fluidly connected with one another.

Figure 4:
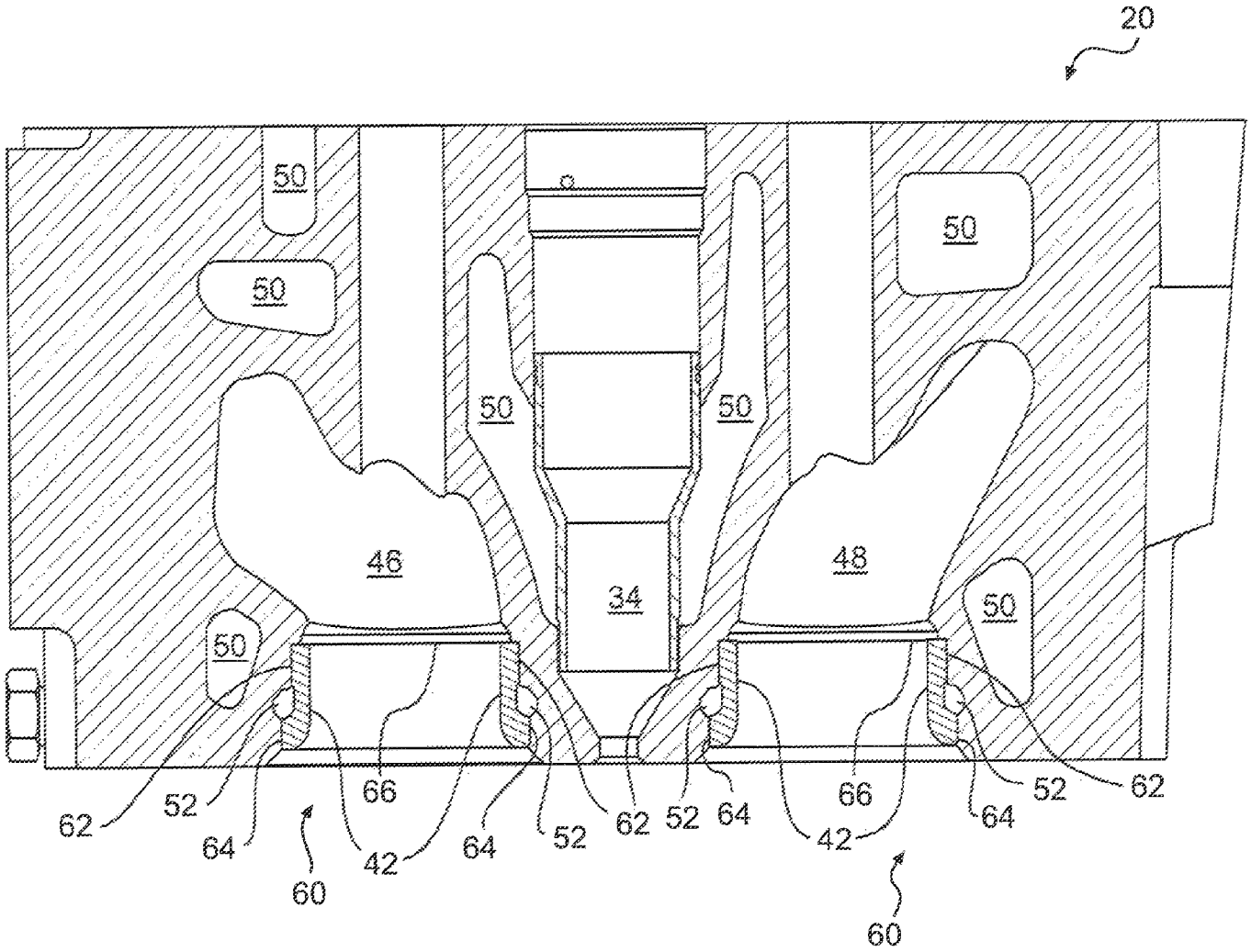
FIG. 4 is a cross-sectional view illustration taken along line 4-4 of the cylinder head assembly of FIG. 2.

FIG. 4 illustrates a cross sectional view illustration taken along line 4-4 of cylinder head 20 shown in FIG. 2. As shown in FIG. 4, each valve seat insert 42 may have an upper radial surface 62 and a lower radial surface 64. It should be noted that upper and lower radial surfaces 62, 64 may have substantially different outer diameters. Upper and lower radial surfaces 62, 64 may engage separate contacting surfaces of stepped bore 60 to at least partially form cooling passage 52. For example, cooling passage 52 may be formed at an intersection of upper and lower radial surfaces 62, 64. More specifically, a recess of valve seat insert 42 may form one side of cooling passage 52, while a recess of stepped bore 60 may form the other side of cooling passage 52. It is contemplated that both the recess of valve seat insert 42 and the recess of stepped bore 60 may be pre-machined prior to installation of valve seat inserts 42. In addition, each valve seat insert 42 may have an annular and generally flat top surface 66 configured to engage a shoulder of stepped bore 60 to help prevent leakage from either intake port 46 or exhaust port 48. Top surface 66 may also control an axial position of valve seat insert 42 within cylinder head 20. It should be noted that top surface 66 may be substantially orthogonal to upper radial surface 62.

The engagement between stepped bore 60 and upper and lower radial surfaces 62, 64 may be a tight interference fit (i.e. press-fit) that provides sealing above and below cooling passage 52 to prevent coolant leakage into combustion chamber 28 (referring to FIG. 1) and into either intake port 46 or exhaust port 48. This engagement may secure valve seat insert 42 within stepped bore 60 as well as adapt to receive and engage the intake or exhaust valves, thereby allowing the valves to selectively seal intake and exhaust passages. Each valve seat insert 42 may be fitted into their respective stepped bores 60 in substantially the same manner.

INDUSTRIAL APPLICABILITY

The disclosed cylinder head assembly may be implemented into any engine application where engine cooling is utilized. Cooling passages 52 may be formed between valve seat inserts 42 and cylinder head 20, thereby allowing increased cooling to valve seat inserts 42 and/or their respective valves. The disclosed valve seat inserts 42 may have radial surfaces 62, 64 and top surfaces 66 that provide sealing both above and below cooling passages 52, thus providing increased protection from leakage into combustion chambers 28 and into either intake port 46 or exhaust port 48. In addition, valve seat inserts 42 may be fully pre-machined prior to installation into their respective stepped bore 60, thereby reducing upfront labor times and costs, as well as facilitating maintenance and/or replacement of valve seat inserts 42. The method for directing cooling through the disclosed cylinder head assembly will now be described below.

Referring to FIGS. 3 and 4, coolant may be directed into cylinder head 20 from one or more additional cooling components of engine 12. Within cylinder head 20, the coolant may be directed into cooling passages 50 via inlet passages 56. The coolant may circulate from cooling passages 50 through cylinder head 20 and be directed into one or more cooling passages 52 surrounding valve seat inserts 42. Coolant may flow between adjacent cooling passages 52 associated with other valve seat inserts 42. Coolant may also be divided into two or more flow streams prior to entering cooling passages 52. For example, coolant may be divided into two substantially equal flow streams prior to entering adjacent cooling passages 52 associated with one of intake or exhaust valve openings 38, 40. The coolant flowing through cooling passages 50, 52 may absorb thermal energy from cylinder head 20, the intake and exhaust valves, and/or valve seat inserts 42. The coolant may then exit cooling passages 50, 52 through one or more outlet passages 58 and continue to additional cooling components of engine 12.

It will be apparent to those skilled in the art that various modifications and variations can be made to the disclosed cylinder head assembly. Other embodiments will be apparent to those skilled in the art from consideration of the specification and practice of the disclosed cylinder head assembly. It is intended that the specification and examples be considered as exemplary only, with a true scope being indicated by the following claims and their equivalents.

What is claimed is:

1. A cylinder head assembly for an engine, comprising:

a cylinder head having a plurality of stepped bores associated with a plurality of valve openings;

a plurality of inserts configured to engage the plurality of stepped bores;

a plurality of cooling passages at least partially formed by the plurality of inserts and the plurality of stepped bores;

at least one inlet passage disposed in the cylinder head and configured to:

direct coolant towards the plurality of cooling passages, and direct coolant from the plurality of cooling passages in a direction away from a cooling passage at least partially surrounding a fuel injector opening at the center of the cylinder head; and at least one outlet passage disposed in the cylinder head at a location in between an adjacent pair of the plurality of valve openings away from a center of the cylinder head and configured to direct coolant away from the plurality of cooling passages, wherein:

each of the plurality of inserts includes a first pre-machined recess forming a first side of a corresponding cooling passage; and each of the plurality of stepped bores includes a second pre-machined recess forming a second side of a corresponding cooling passage.

2. The cylinder head assembly of claim 1, wherein each of the plurality of cooling passages substantially surrounds a periphery of a corresponding insert.

3. The cylinder head assembly of claim 1, wherein each of the plurality of inserts is pressed into a corresponding stepped bore with an interference fit.

4. The cylinder head assembly of claim 1, wherein each of the plurality of inserts includes an upper radial surface and a lower radial surface having substantially different outer diameters.

5. The cylinder head assembly of claim 4, wherein the upper and lower radial surfaces provide sealing both above and below a corresponding cooling passage.

6. The cylinder head assembly of claim 4, wherein a corresponding cooling passage is located at an intersection of the upper and lower radial surfaces.

7. The cylinder head assembly of claim 1, wherein each of the plurality of inserts and each of the plurality of stepped bores are pre-machined prior to engagement.

8. The cylinder head assembly of claim 7, wherein the pre-machining process includes pre-machining both inner and outer surfaces of a corresponding insert.

9. The cylinder head assembly of claim 1, wherein the plurality of valve openings includes a pair of intake valve openings and a pair of exhaust valve openings.

10. The cylinder head assembly of claim 1, wherein the plurality of valve openings are evenly spaced about the fuel injector opening.

11. The cylinder head assembly of claim 1, wherein each of the plurality of inserts includes a generally flat top surface configured to engage a shoulder of a corresponding stepped bore to prevent air, coolant, and/or exhaust leakage into a combustion chamber of the engine.

12. The cylinder head assembly of claim 1, wherein the at least one outlet passage is disposed a distance radially outward from the fuel injector opening located at the center of the cylinder head.

13. A method of cooling a cylinder head assembly, comprising:

directing coolant into a cylinder head via at least one inlet passage; and circulating coolant from the at least one inlet passage through a plurality of cooling passages at least partially surrounding and formed by a plurality of pre-machined valve inserts;

directing coolant from the plurality of cooling passages in a direction away from a cooling passage at least partially surrounding a fuel injector opening located at the center of the cylinder head; and directing coolant out of the cylinder head via at least one outlet passage located in between an adjacent pair of the plurality of inserts away from a center of the cylinder head.

14. The method of claim 13, further including dividing coolant into two substantially equal flow streams prior to entering adjacent cooling passages.

15. An engine, comprising:

an engine block at least partially defining a plurality of cylinders; and a plurality of cylinder head assemblies associated with the plurality of cylinders, each cylinder head assembly including:

a cylinder head at least partially defining:

a pair of intake valve openings;

a pair of exhaust valve openings;

a fuel injector opening centrally-located between the intake and exhaust valve openings; and a plurality of stepped bores associated with the intake and exhaust valve openings;

a plurality of valve seat inserts, each valve seat insert being pressed into a respective one of the plurality of stepped bores;

a plurality of cooling passages at least partially formed by the plurality of valve seat inserts and the plurality of stepped bores;

at least one inlet passage disposed in the cylinder head and configured to:

direct coolant towards the plurality of cooling passages, and direct coolant from the plurality of cooling passages in a direction away from a cooling passage at least partially surrounding a fuel injector opening at the center of the cylinder head; and at least one outlet passage disposed in the cylinder head at a location in between an adjacent pair of the plurality of valve openings away from the fuel injector opening and configured to direct coolant away from the plurality of cooling passages, wherein:

each valve seat insert includes a first pre-machined recess forming a first side of one of the plurality of cooling passages; and each stepped bore includes a second pre-machined recess forming a second side of the one of the plurality of cooling passages.

16. The engine of claim 15, wherein the at least one outlet passage is disposed a distance radially outward from the fuel injector opening.

17. The engine of claim 15, wherein the at least one inlet passage directs coolant to:

a first inlet located between an adjacent pair of the plurality of intake valve openings; and a second inlet located between an adjacent pair of the plurality of exhaust valve openings.

18. The engine of claim 15, wherein the at least one outlet passage includes:

a first outlet passage located between a first of the plurality of intake valve openings and a first of the plurality of exhaust valve openings; and a second outlet passage located between a second of the plurality of intake valve openings and a second of the plurality of exhaust valve openings.

* * * * *